US012234595B2

(12) United States Patent
Angelini et al.

(10) Patent No.: US 12,234,595 B2
(45) Date of Patent: Feb. 25, 2025

(54) BACK WALL ENCLOSURE FOR A DRUM WITHIN A LAUNDRY APPLIANCE THAT SEPARATES A PROCESSING SPACE FROM A BLOWER HOUSING

(71) Applicant: WHIRLPOOL CORPORATION, Benton Harbor, MI (US)

(72) Inventors: Marco Angelini, Ascoli Piceno (IT); Matteo Carnevale, Esanatoglia (IT); Crescenzo Iannicelli, Fabriano (IT); Mauro Mancini, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 255 days.

(21) Appl. No.: 18/075,819

(22) Filed: Dec. 6, 2022

(65) Prior Publication Data

US 2024/0183098 A1 Jun. 6, 2024

(51) Int. Cl.

| | |
|---|---|
| ***D06F 37/26*** | (2006.01) |
| ***D06F 25/00*** | (2006.01) |
| *D06F 37/04* | (2006.01) |
| *D06F 37/30* | (2020.01) |

(52) U.S. Cl.
CPC ..... *D06F 37/267* (2013.01); *D06F 25/00* (2013.01); *D06F 37/04* (2013.01); *D06F 37/30* (2013.01)

(58) Field of Classification Search
CPC ..... D06F 37/267
See application file for complete search history.

(56) References Cited

U.S. PATENT DOCUMENTS

| | | | |
|---|---|---|---|
| 2,892,335 | A | 6/1959 | Gray, Jr. |
| 2,940,179 | A | 6/1960 | Czech |
| 3,006,176 | A | 10/1961 | Behrens |
| 3,333,346 | A | 8/1967 | Brucken |
| 4,338,730 | A | 7/1982 | Tatsumi et al. |
| 4,665,628 | A | 5/1987 | Clawson |
| 4,974,339 | A | 12/1990 | Kawamura et al. |
| 5,454,171 | A | 10/1995 | Ikeda et al. |
| 8,042,283 | B2 | 10/2011 | Nakiri |
| 9,109,318 | B2 | 8/2015 | Kulkarni et al. |
| 10,513,816 | B2 | 12/2019 | Nakamoto |
| 11,008,691 | B2 | 5/2021 | Garnek et al. |
| 11,085,141 | B2 | 8/2021 | Lee et al. |
| 2006/0005581 | A1 | 1/2006 | Banba |

(Continued)

FOREIGN PATENT DOCUMENTS

| | | | |
|---|---|---|---|
| CN | 110438725 | A | 11/2019 |
| EP | 0341497 | A1 | 11/1989 |

(Continued)

*Primary Examiner* — Jason Y Ko
(74) *Attorney, Agent, or Firm* — Price Heneveld LLP

(57) ABSTRACT

A combination washing and drying appliance includes a tub that is disposed within a cabinet. A drum is rotationally operable within the tub about a rotational axis. An airflow path is defined within an interstitial space between the drum and the tub. A blower fan operates to direct process air through the airflow path. The blower fan is disposed within a blower enclosure that is defined by a back wall of the drum and a blower housing that is attached to the tub. Engagement of the back wall of the drum and the blower housing of the tub defines a slidable engagement that is selectively sealed during operation of the blower fan to prevent the process air from leaving the airflow path and to further prevent aspiration of ambient air to the airflow path.

20 Claims, 12 Drawing Sheets

(56) References Cited

U.S. PATENT DOCUMENTS

| | | | |
|---|---|---|---|
| 2009/0064533 | A1 | 3/2009 | Nakiri |
| 2019/0112742 | A1 | 4/2019 | Yu et al. |
| 2020/0032445 | A1 | 1/2020 | Lee et al. |
| 2021/0254250 | A1 | 8/2021 | Garnek et al. |
| 2022/0145516 | A1 | 5/2022 | Masters, Jr. |
| 2022/0356624 | A1 | 11/2022 | Carnevale et al. |

FOREIGN PATENT DOCUMENTS

| | | | |
|---|---|---|---|
| EP | 3701076 | A1 | 9/2020 |
| EP | 3919665 | A1 | 12/2021 |
| EP | 4089222 | A1 | 11/2022 |
| JP | 61284300 | A | 12/1986 |
| JP | 05131094 | A | 5/1993 |
| JP | 3723689 | B2 | 12/2005 |
| WO | 2004104288 | A1 | 12/2004 |
| WO | 2009041345 | A1 | 4/2009 |

BACK WALL ENCLOSURE FOR A DRUM WITHIN A LAUNDRY APPLIANCE THAT SEPARATES A PROCESSING SPACE FROM A BLOWER HOUSING

BACKGROUND OF THE DISCLOSURE

The present disclosure generally relates to a laundry appliance, and more specifically, to a combination washing and drying appliance that incorporates a back wall for the rotating drum that separates the processing space within the drum from a blower housing that is contained within a space defined between the tub and the rotating drum.

SUMMARY OF THE DISCLOSURE

According to one aspect of the present disclosure, a combination washing and drying appliance includes a tub that is disposed within a cabinet. A drum is rotationally operable within the tub about a rotational axis. An airflow path is defined within an interstitial space between the drum and the tub. A blower fan operates to direct process air through the airflow path. The blower fan is disposed within a blower enclosure that is defined by a back wall of the drum and a blower housing that is attached to the tub. Engagement of the back wall of the drum and the blower housing of the tub defines a slidable engagement that is selectively sealed during operation of the blower fan to prevent the process air from leaving the airflow path and to further prevent aspiration of ambient air to the airflow path.

According to another aspect of the present disclosure, a combination washing and drying appliance includes a tub that is disposed within a cabinet. A drum has a back wall and is rotationally operable within the tub about a rotational axis. An airflow path is defined within an interstitial space between the drum and the tub. A drain is disposed within a lower section of the tub. An outlet for the drain is disposed within the airflow path. A blower fan delivers process air through the airflow path that is contained within the tub. The blower fan is disposed between the back wall of the drum and a blower housing of the tub. The back wall rotates with the drum and is slidably engaged with the blower housing to define a labyrinth seal. The blower fan rotationally operates within a blower enclosure that is defined between the back wall and the blower housing. Moisture collected in the airflow path is directed to the outlet of the drain.

According to yet another aspect of the present disclosure, an air handling system for a laundry appliance includes a tub that is disposed within a cabinet. A drum has a back wall and is rotationally operable within the tub about a rotational axis. An airflow path is defined within an interstitial space between the drum and the tub. A blower fan delivers process air through the airflow path that is contained within the tub. The blower fan is disposed between the back wall of the drum and a blower housing of the tub. The back wall rotates with the drum and is slidably engaged with the blower housing to define a labyrinth seal. The blower fan rotationally operates within a blower enclosure that is defined between the back wall and the blower housing.

These and other features, advantages, and objects of the present disclosure will be further understood and appreciated by those skilled in the art by reference to the following specification, claims, and appended drawings.

Figure 1:
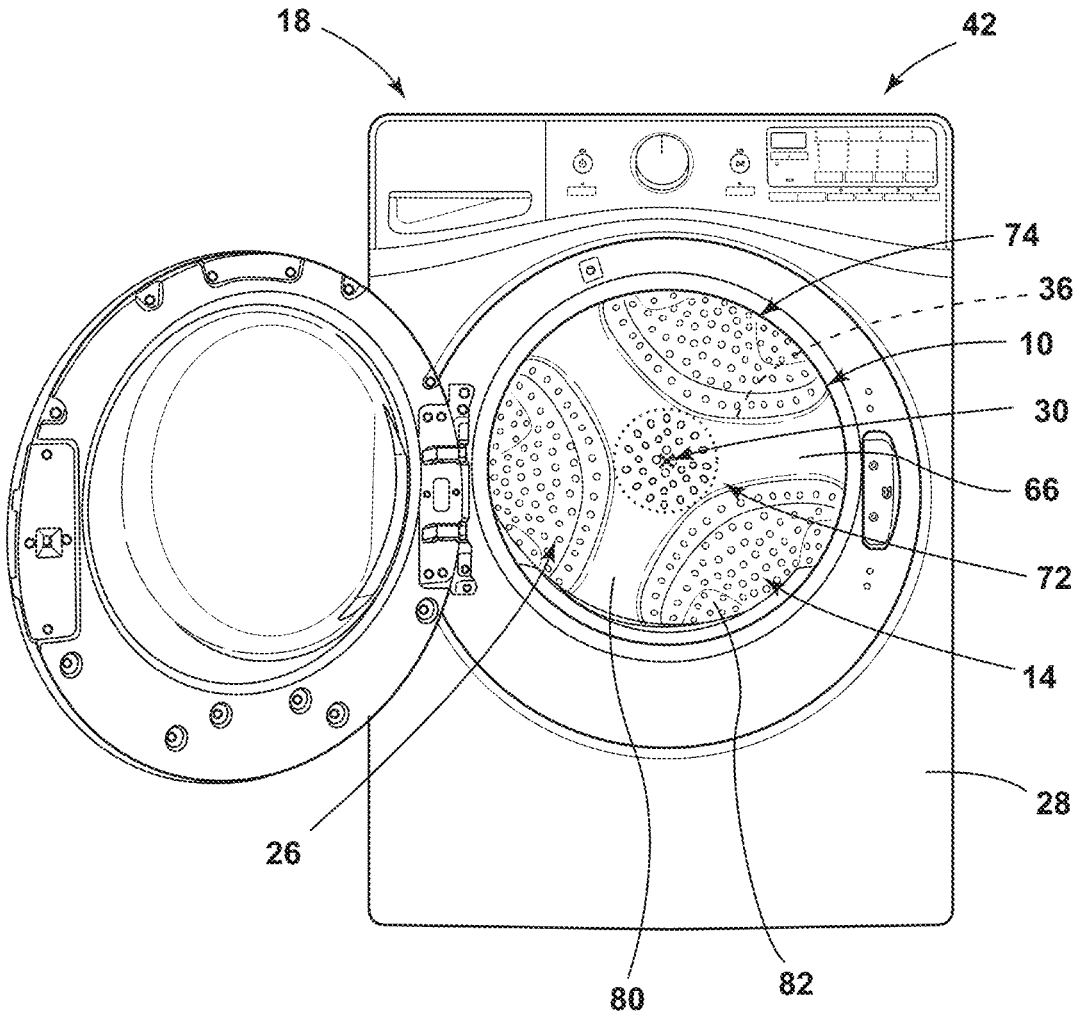
FIG. 1 is a front perspective view of a laundry appliance that incorporates an aspect of the back wall for the rotating drum.
Figure 2:
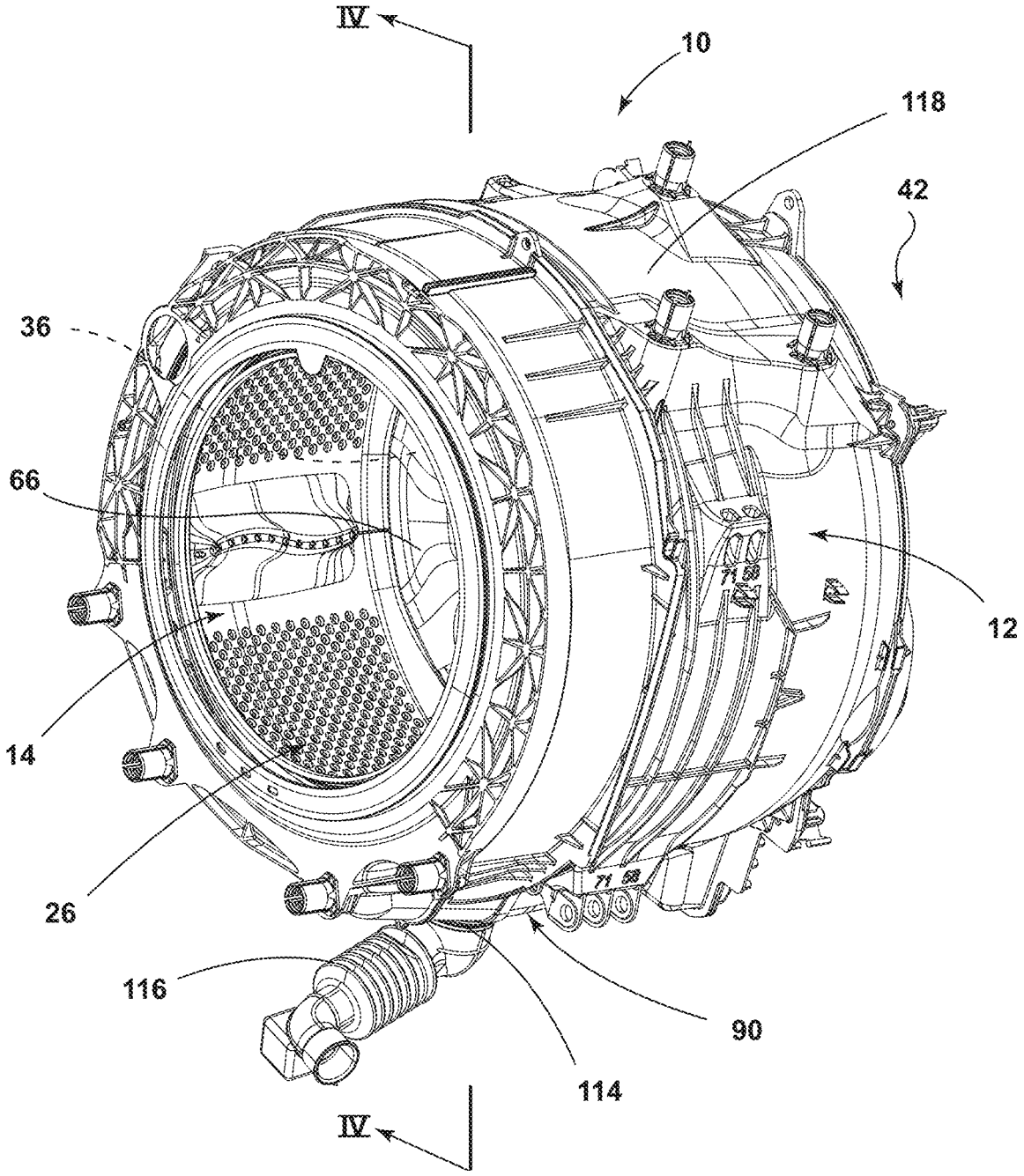
FIG. 2 is a perspective view of a tub assembly that houses a rotating drum, including an aspect of the back wall for dividing the processing space from the blower housing.
Figure 3:
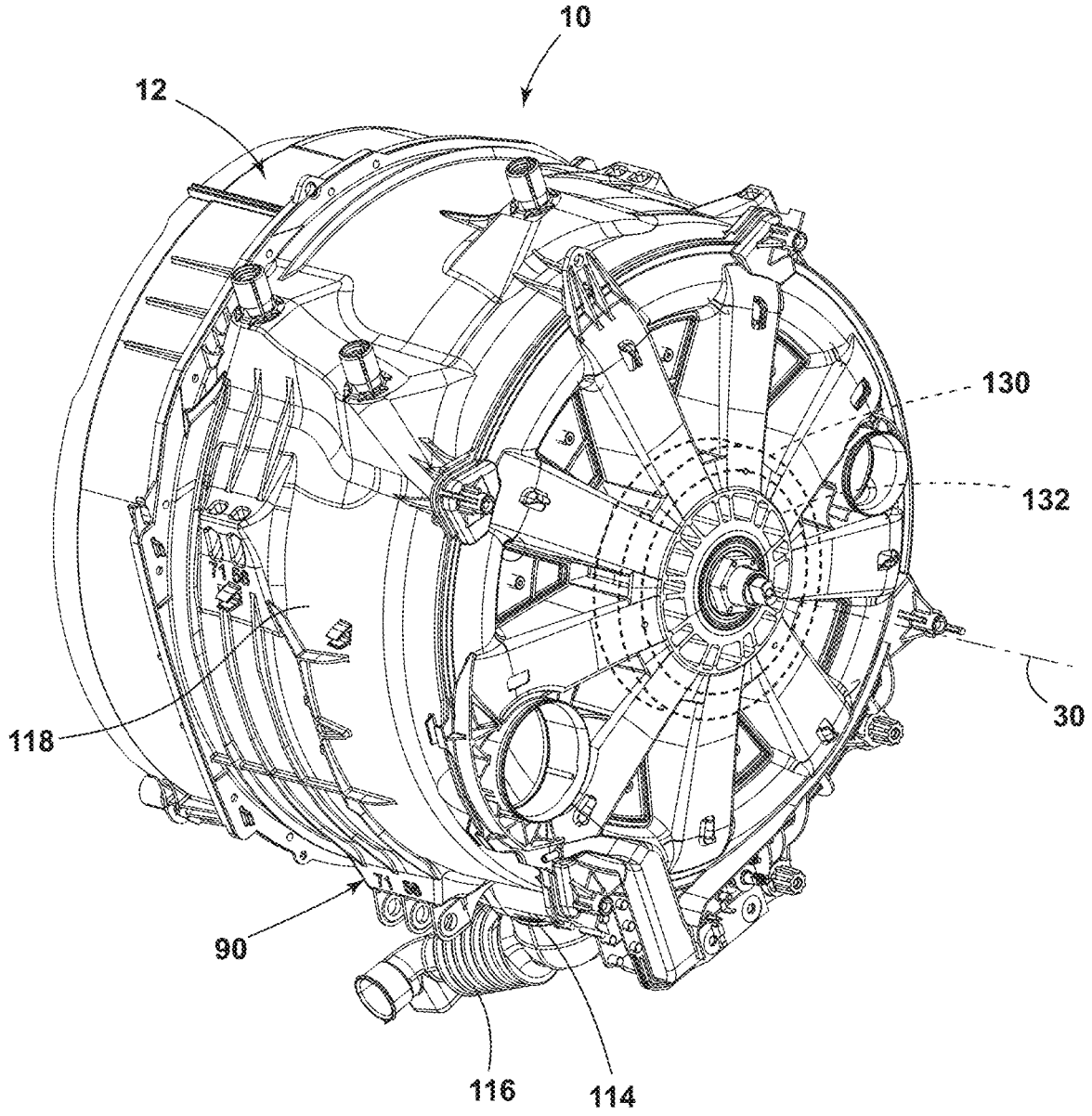
FIG. 3 is a perspective view of the tub assembly of FIG. 2.
Figure 4:
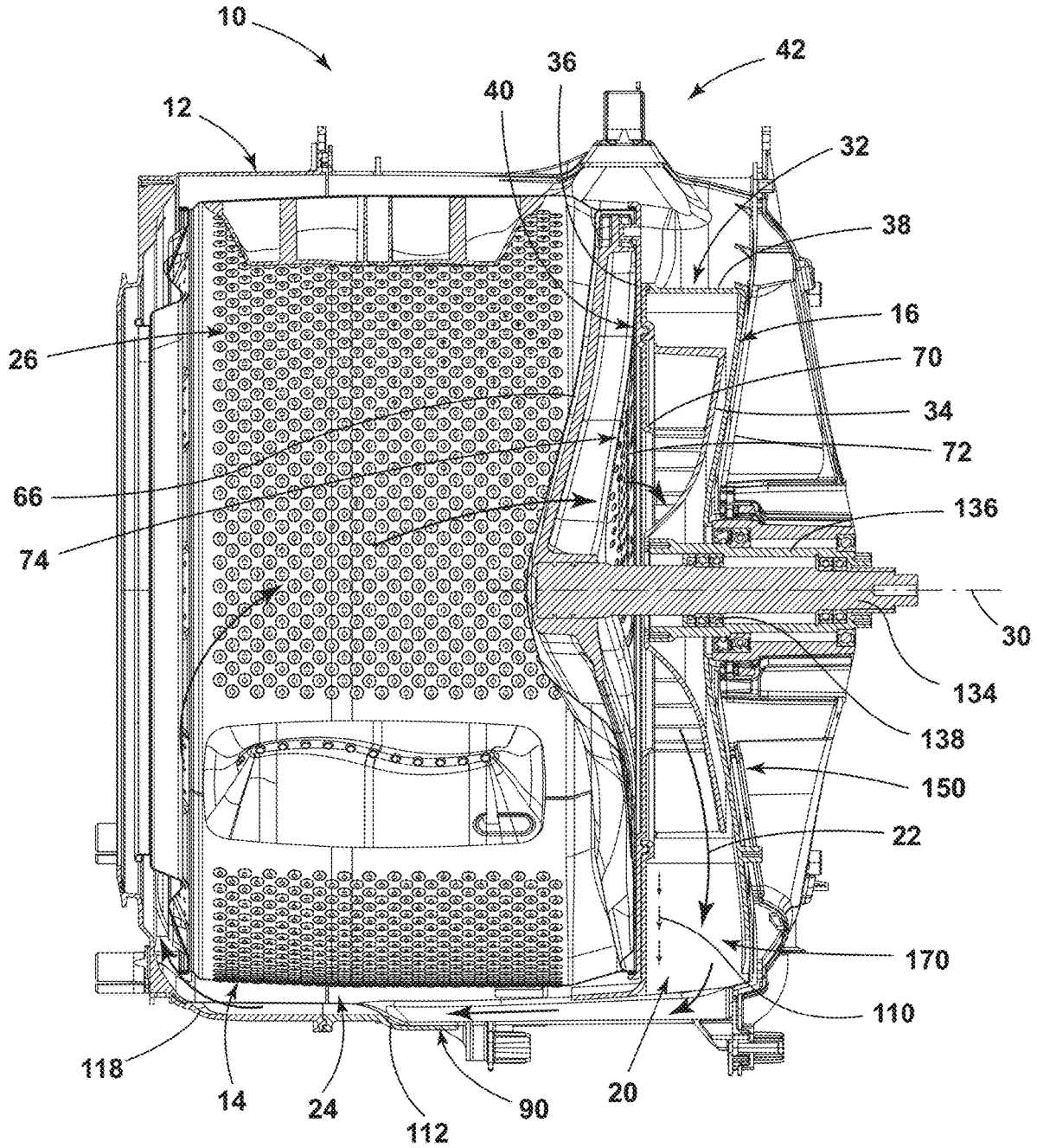
FIG. 4 is a cross-sectional view of the tub assembly of FIG. 2 taken along the line IV-IV.
Figure 5:
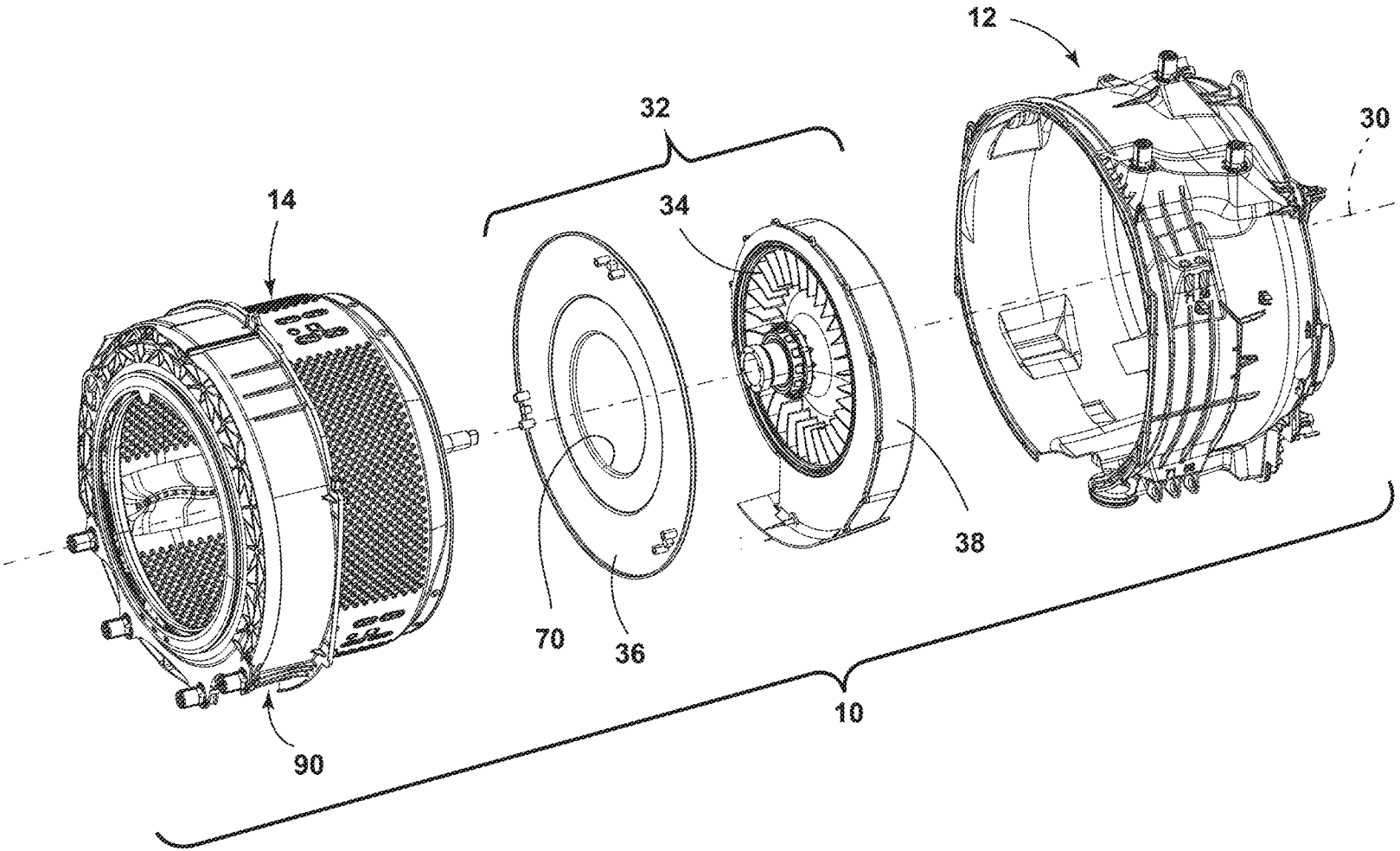
FIG. 5 is an exploded perspective view of the tub assembly of FIG. 2.
Figure 6:
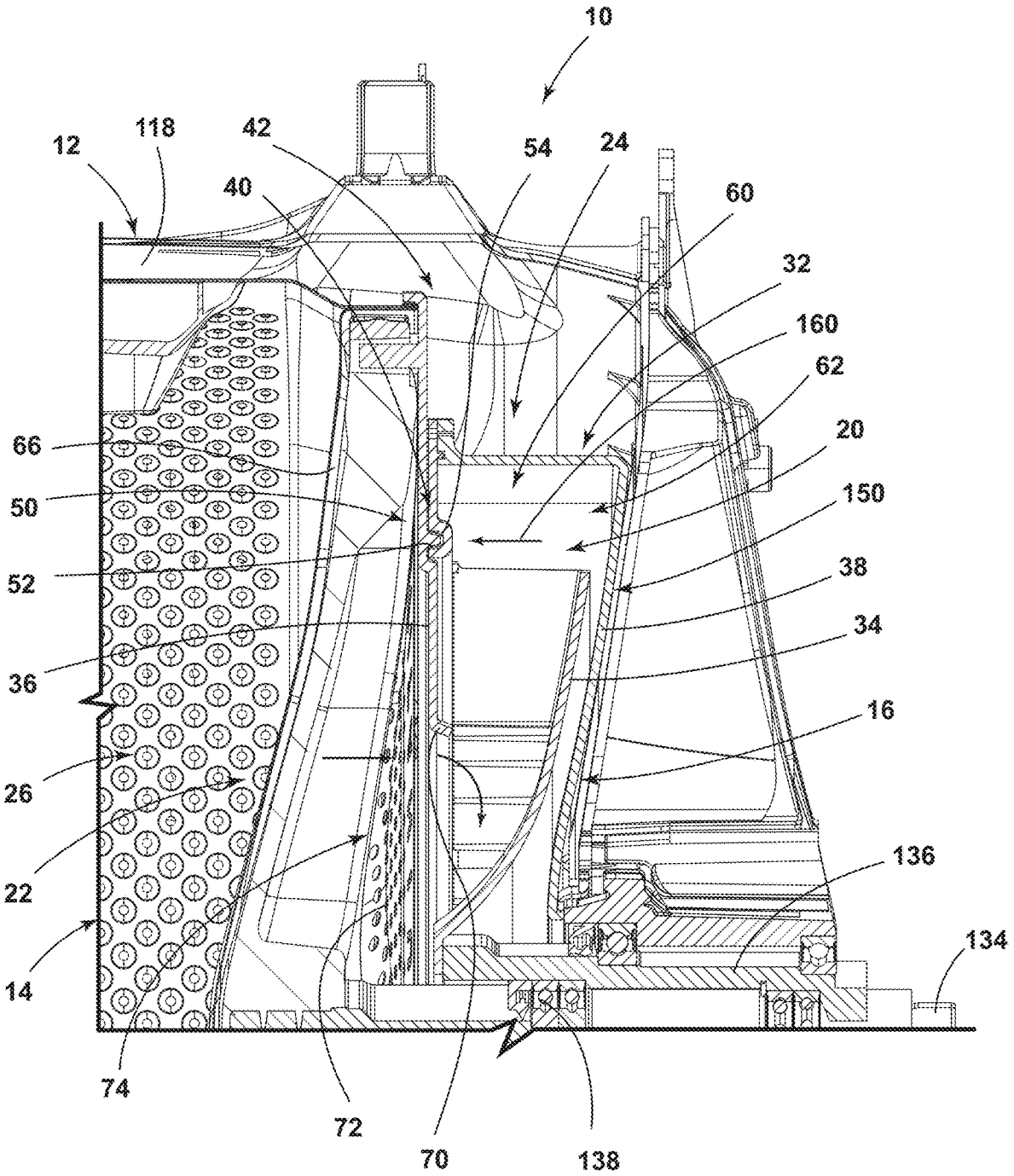
FIG. 6 is an enlarged cross-sectional view of the tub assembly of FIG. 4 taken at area VI and showing the blower fan in operation.
Figure 7:
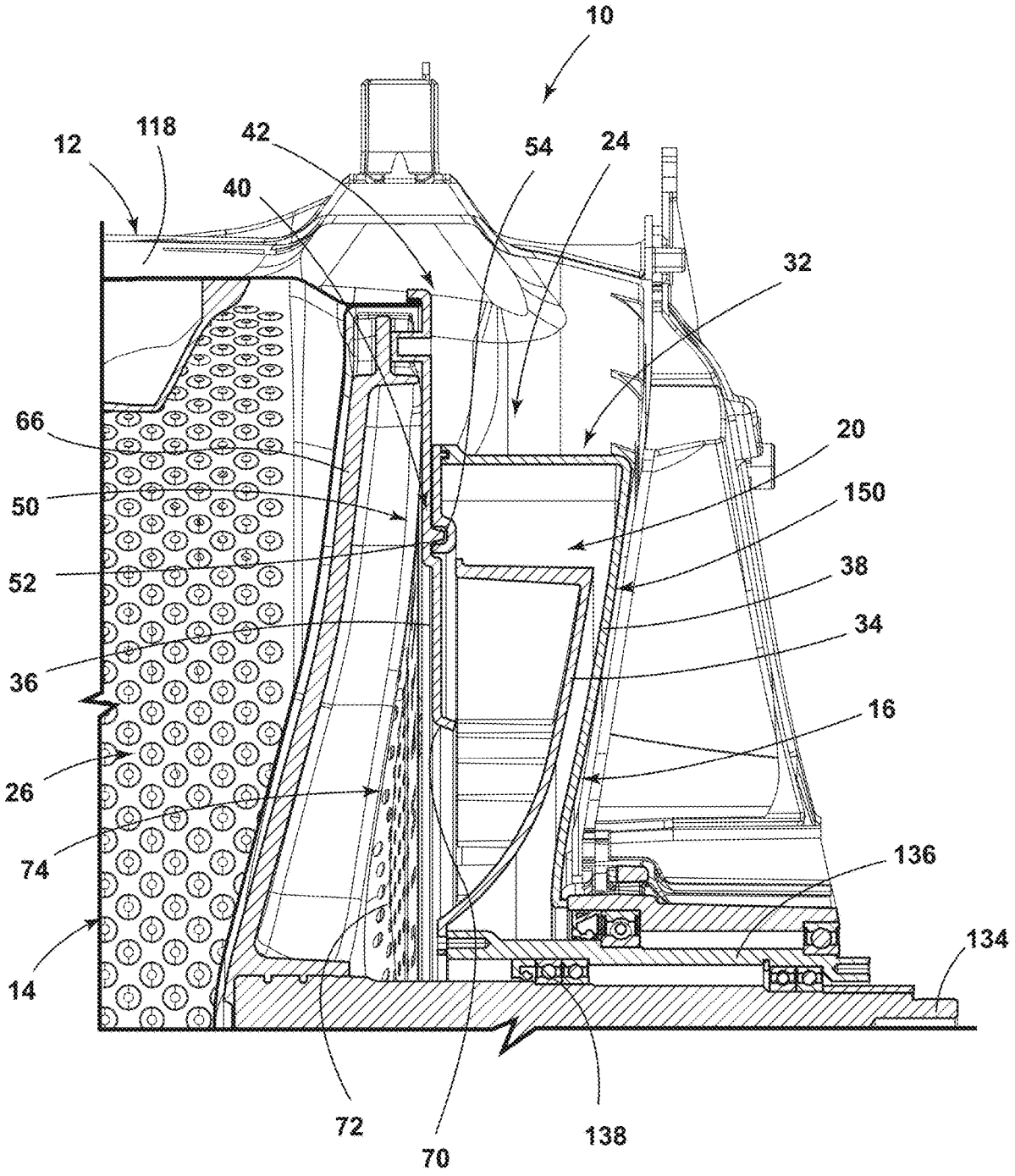
FIG. 7 is a cross-sectional view of the tub assembly of FIG. 6, and showing the blower fan in a non-rotating idle state.
Figure 8:
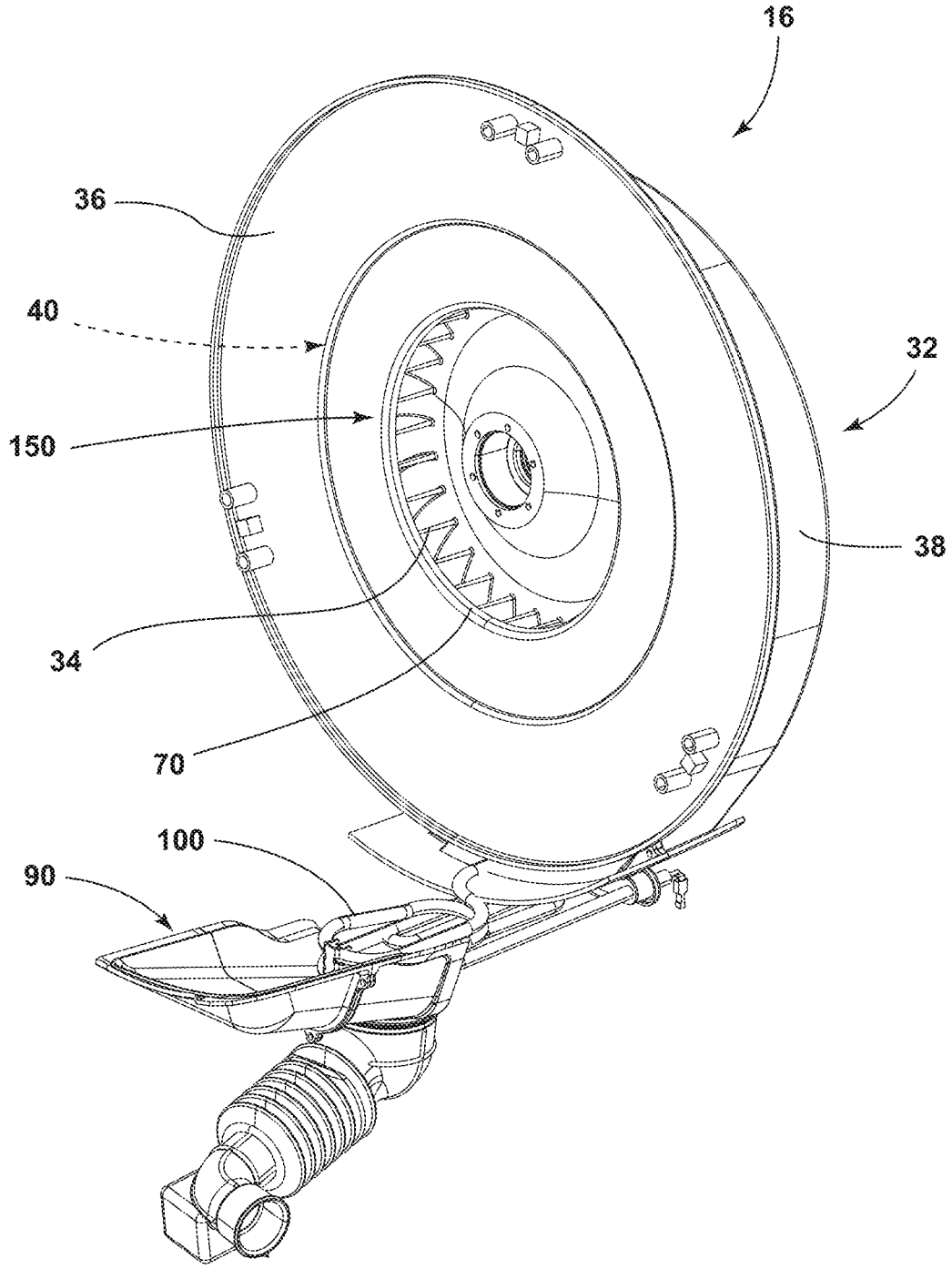
FIG. 8 is a perspective view of an aspect of the blower housing that incorporates the back wall of the drum.
Figure 9:
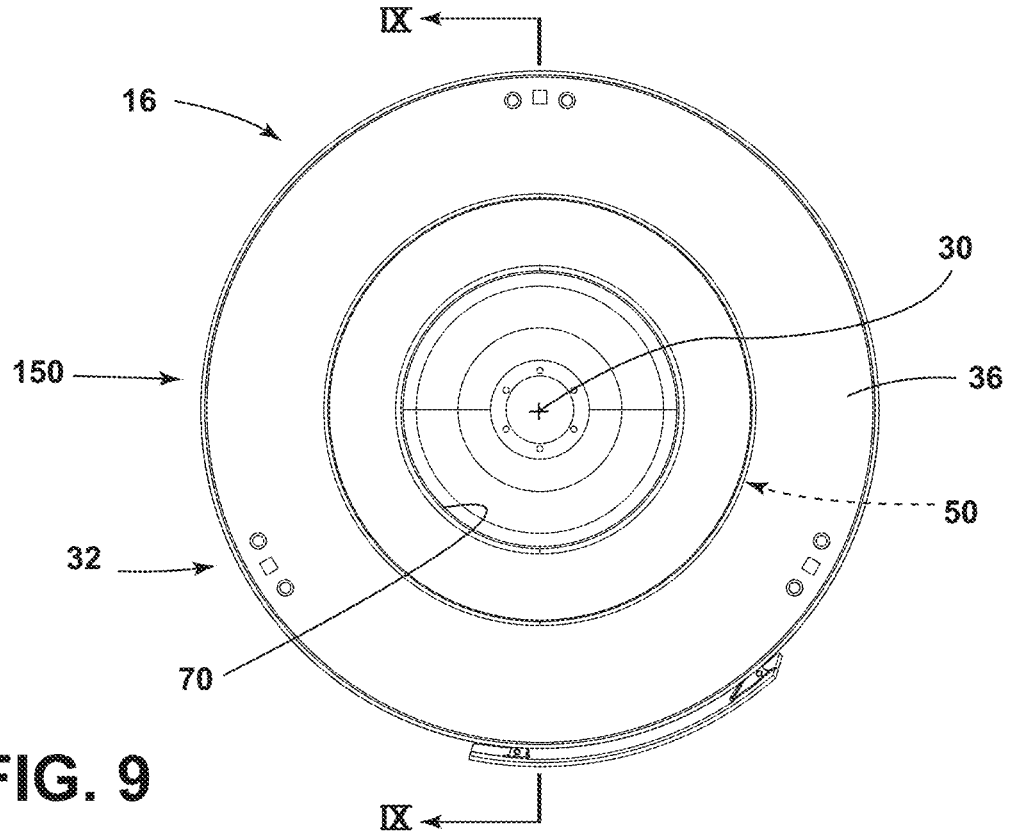
FIG. 9 is a front elevational view of the blower housing of FIG. 8.
Figure 10:
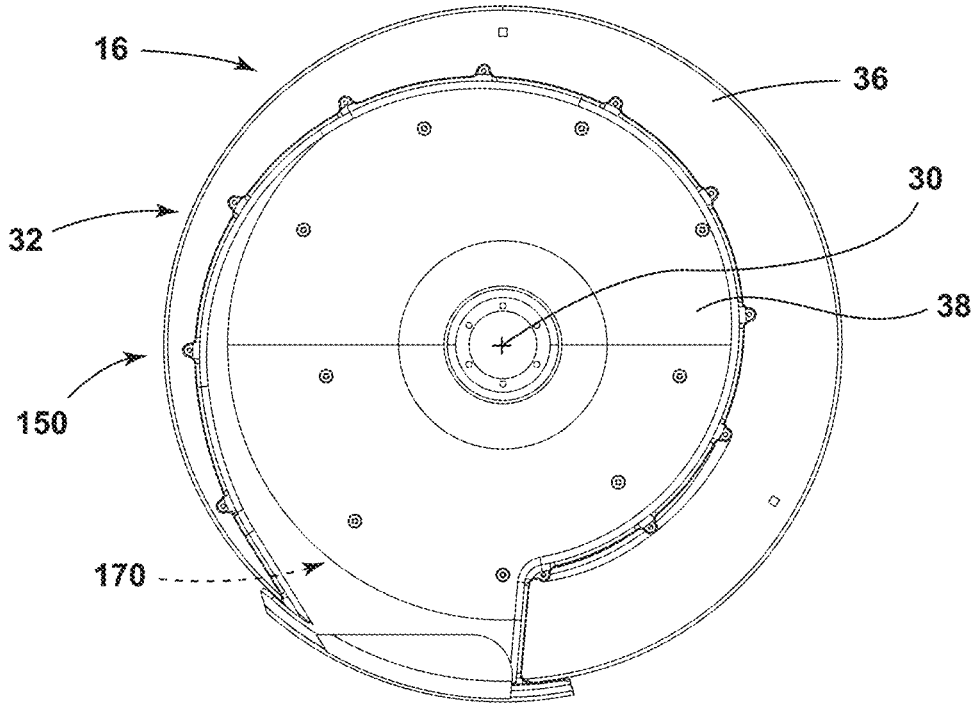
FIG. 10 is a rear elevational view of the blower housing of FIG. 8.

The components in the figures are not necessarily to scale, emphasis instead being placed upon illustrating the principles described herein.

DETAILED DESCRIPTION

The present illustrated embodiments reside primarily in combinations of method steps and apparatus components related to a tub assembly for a combination washing and drying appliance that incorporates a rotating drum having a back wall that separates the processing space from a blower housing that is contained in the space between the tub and the rotating drum. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-13, reference numeral 10 generally designates a tub assembly having a tub 12, a drum 14, and a blower assembly 16 that is disposed between the drum 14 and the tub 12. The tub assembly 10 is typically incorporated as part of a combination washing and drying appliance 18. This appliance 18 includes an airflow path 20 that is disposed within the tub assembly 10. The airflow path 20 is entirely disposed within the tub 12 for moving process air 22 within an interstitial space 24 defined between the tub 12 and the drum 14. The airflow path 20 also extends through a processing space 26 defined within the drum 14.

According to various aspects of the device, the appliance 18 includes the tub 12 that is disposed within an outer cabinet 28. The drum 14 is rotationally operable within the tub 12 and operates about a rotational axis 30. The airflow path 20 is defined within the interstitial space 24 that is located between the drum 14 and the tub 12. At least a portion of this interstitial space 24 defines a blower enclosure 32 that houses the blower assembly 16. A blower fan 34 of the blower assembly 16 operates to direct the process air 22 through the airflow path 20. The blower fan 34 is disposed within the blower enclosure 32 that is defined by a back wall 36, which is attached to the drum 14, and a blower housing 38, which is attached to the tub 12. Engagement of the back wall 36 of the drum 14 with the blower housing 38 of the tub 12 defines a slidable engagement 40 that allows the drum 14, along with the back wall 36, to rotate relative to the tub 12 and the blower housing 38. Engagement of the back wall 36 of the drum 14 with the blower housing 38 defines the slidable engagement 40 that is selectively sealed during operation of the blower fan 34 about the rotational axis 30 to prevent aspiration of ambient air 42 into the airflow path 20. Additionally, this selectively sealed engagement can also prevent the process air 22 from leaving the airflow path 20 into areas that are outside of the airflow path 20 defined between the tub 12 and the drum 14. The blower fan 34 typically operates about the same rotational axis 30 as that of the drum 14. Additionally, the back wall 36 is fixedly attached to the drum 14 and the blower housing 38 is fixedly attached to the tub 12.

Referring again to FIGS. 2-13, the slidable engagement 40 that is formed between the drum 14 and the tub 12 can be in the form of a labyrinth seal 50 that is formed at an interface between the back wall 36 of the drum 14 and the blower housing 38. This labyrinth seal 50 provides for the slidable engagement 40 between the back wall 36 of the drum 14 and the blower housing 38 of the tub 12. Again, the slidable engagement 40 of the labyrinth seal 50 allows the drum 14 to operate within the tub 12. This labyrinth seal 50 can include various labyrinth-type engagements that can include an annular protrusion 52 of the back wall 36 of the drum 14 that extends toward the blower housing 38. The blower housing 38 can include an annular channel 54 that receives the annular protrusion 52. Through this engagement between the annular protrusion 52 and the annular channel 54, the labyrinth seal 50 allows for the rotational operation of the drum 14 relative to the tub 12.

Additionally, during operation of the blower fan 34, the blower fan 34 defines a high-pressure area 60 within the blower enclosure 32. This high-pressure area 60 is typically disposed near the slidable engagement 40 between the back wall 36 and the blower housing 38. Accordingly, this labyrinth seal 50 is acted upon by the increased air pressure 62 within the high-pressure area 60. This increased air pressure 62 serves to increase the seal strength of the labyrinth seal 50 such that ambient air 42 is less capable or incapable of infiltrating into the airflow path 20 via the labyrinth seal 50. Stated another way, during operation of the blower fan 34, the increased air pressure 62 within the high-pressure area 60 prevents aspiration of ambient air 42 into the airflow path 20 via the interface defined by the labyrinth seal 50. Also, the slidable and sealed engagement of the labyrinth seal 50 during operation of the blower fan 34 prevents expiration of the process air 22 from the airflow path 20, through the labyrinth seal 50 and to areas external of the airflow path 20.

Referring again to FIGS. 1-11, a portion of the airflow path 20 extends through the interstitial space 24 defined between the tub 12 and the drum 14. During operation of the blower fan 34, the process air 22 is drawn from the processing space 26 of the drum 14 and into the blower enclosure 32 through an aperture 70 defined within the back wall 36 of the drum 14. One or more filtration members 72 can be positioned proximate the aperture 70 of the back wall 36 to provide a filtering functionality as the process air 22 moves through the aperture 70 defined within the back wall 36. These filtration members 72 can include perforated panels, mesh screens, and other similar filtration mechanism that can be used to separate particulate matter from the process air 22 (or other fluid) moving through the airflow path 20. In particular the filtration member 72 filters the particulate matter as the process air 22 moves from the processing space 26 and into the blower enclosure 32. In certain aspects of the device, the filtration member 72 can be incorporated into a contoured wall 66 that is positioned forward of the back wall 36. This contoured wall 66 can include ridges 80 and valleys 82 as well as a series of perforated sections 74 that define the filtration member 72. The contoured wall 66 can be attached to the back wall 36 and can rotate with the drum 14 and the back wall 36. The contoured wall 66, in certain aspects of the device, can also be selectively operable to rotate independently with respect to the back wall 36 or in unison with the back wall 36.

In certain aspects of the device the back wall 36 of the drum 14 defines a portion of the processing space 26. In such an aspect, the filtration member 72 can be attached to the back wall 36. Typically, the filtration member 72 is attached to the back wall 36 as the contoured wall 66 described herein. As described herein, this contoured wall 66 can include the various ridges 80 and valleys 82. These ridges 80 and valleys 82 are typically positioned adjacent to the back wall 36 for providing an agitating or tumbling effect on articles being processed in the drum 14. In addition, the contoured wall 66 can include the filtration member 72 in the form of a plurality of perforated sections 74 that allow process air 22 to move therethrough, while capturing particulate material within the filtration member 72. The contoured wall 66 and the perforated sections 74 of the filtration member 72 allow the process air 22 to move through the aperture 70 defined within the back wall 36 and into the blower enclosure 32. In this aspect of the device, the contoured wall can define the processing space 26. In each of these aspects of the device, the back wall 36 defines the blower enclosure 32 that houses the blower fan 34. It is also contemplated that the back wall 36, in certain aspects of the device, can include the ridges 80 and valleys 82 that define the processing space 26.

Referring again to FIGS. 1-7, the airflow path 20 continues through the blower enclosure 32 that is defined between the back wall 36 of the drum 14 and the blower housing 38 of the tub 12. Typically, this blower housing 38 can take the form of a cochlear housing that can be used to direct the process air 22 from the blower fan 34 to downstream portions of the airflow path 20. These downstream portions of the airflow path 20 are typically positioned within a lower section 90 of the tub 12 and beneath the drum 14. The process air 22 then moves upward to be reintroduced into the processing space 26 of the rotating drum 14.

According to various aspects of the device, certain heat exchange mechanisms 100 can be disposed within the airflow path 20 for heating and/or cooling the process air 22 as it moves through the airflow path 20. In certain aspects of the device, these heat exchange mechanisms 100 can include heating elements, heat pump systems, air-to-air heat exchangers, condensers, combinations thereof, and other similar heat exchange mechanisms 100.

Referring again to FIGS. 2-11, within the airflow path 20 defined within a lower section 90 of the tub 12, the heat exchange mechanism 100 can include a cooler such as an evaporator or an air-to-air heat exchanger that decreases the temperature of the process air 22 and, in turn, separates condensate 110 from the process air 22. This condensate 110 can be collected within the lower section 90 of the tub 12, such as within a sump 112. This sump 112 can be attached to an outlet 114 that directs this condensate 110 to a drain 116 that is extends from the lower section 90 of the tub 12. The drain 116 typically includes a pump that can direct the condensate 110 and/or wash fluid to be expelled from the appliance 18 or recirculated through a fluid delivery system. The outlet 114 is typically defined within an outer wall 118 of the tub 12 within the lower section 90. This sump 112 having the outlet 114 collects the condensate 110 and directs the condensate 110 to the drain 116 for moving the captured condensate 110 to an external area or to a collection within the appliance 18.

Referring again to FIGS. 1-4, the tub assembly 10 can include a first motor 130 that rotationally operates the blower fan 34 and a second motor 132 that rotationally operates the drum 14. The first and second motors 130, 132 can be in the form of belt-drive motors, direct drive motors, combinations thereof, and other similar driving mechanisms. The first motor 130 is coupled to the tub 12 via an inner drive shaft 134, typically a solid shaft that extends from the rear wall 182 of the tub 12 and to the drum 14. The second motor 132 is coupled with the blower fan 34 via a hollow drive tube 136 that surrounds a portion of the inner drive shaft 134. Various bearings 138 can be positioned between the inner drive shaft 134 and the hollow drive tube 136. Additionally, certain external bearings 138 can be positioned between the hollow drive tube 136 and the tub 12. Portions of the tub 12 can include a bearing housing that is attached or incorporated within the tub 12.

Referring again to FIGS. 1-13, an air handling system 150 for the combination washing and drying appliance 18 includes the tub 12 that is disposed within the cabinet 28. The drum 14 includes the back wall 36. The drum 14 is rotationally operable within the tub 12 about the rotational axis 30. The airflow path 20 is entirely contained within the tub 12 and is defined by the interstitial space 24 between the drum 14 and the tub 12, as well as the processing space 26 contained within the drum 14. The blower fan 34 delivers the process air 22 through the airflow path 20. As described herein, the blower fan 34 is disposed between the back wall 36 of the drum 14 and the blower housing 38 of the tub 12. The back wall 36 rotates with the drum 14 and is slidably engaged within the blower housing 38 that is attached to the tub 12. This slidable engagement 40 between the back wall 36 of the drum 14 and the blower housing 38 of the tub 12 defines a labyrinth seal 50. Through this engagement, the blower fan 34 rotationally operates within the blower space or blower enclosure 32 defined between the back wall 36 and the blower housing 38 and contemporaneously allows the back wall 36 of the drum 14 to rotate relative to the blower housing 38 of the tub 12.

As described herein, the labyrinth seal 50 is disposed proximate the high-pressure area 60 of the blower enclosure 32. This high-pressure area 60 is generated during operation of the blower fan 34. During operation of the blower fan 34, the blower housing 38 and the back wall 36 are biased against one another within the labyrinth seal 50. This biasing force 160 is a result of the increased air pressure 62 that is generated within the high-pressure area 60 of the blower housing 38. This increased air pressure 62 increases the seal integrity of the labyrinth seal 50. This increased seal integrity prevents aspiration of ambient air 42 into the airflow path 20. In certain aspects of the device, the increased air pressure 62 can also prevent expiration of process air 22 away from the airflow path 20.

According to various aspects of the device, during operation of the blower fan 34, the increased air pressure 62 increases the seal integrity of the labyrinth seal 50 that is defined between the back wall 36 of the drum 14 and the blower housing 38 of the tub 12. This labyrinth seal 50 includes certain sliding interface engagements such as lubricants, bearings 138, and other similar materials and mechanisms that allow slidable operation of the back wall 36 of the drum 14 relative to the blower housing 38 of the tub 12 during operation of the blower.

During operation of the blower, a drying-function of the combination washing and drying appliance 18 is typically being performed. During this drying-function, the drying undergoes a tumble-type operation that includes a relatively slow rotation of the drum 14 within the tub 12. Because the blower fan 34 is operating during the drying function, the labyrinth seal 50 has a greater seal integrity as a result of the increased air pressure 62. Accordingly, because of the slower operation of the drum 14 in the tumble operation, the increased seal integrity, and potentially greater friction, does not interfere with the slower rotation of the drum 14.

During washing-type functions of the combination washing and drying appliance 18, a rinse and spin cycle can be utilized for extracting wash fluid from articles being processed and from the processing space 26, generally. During this extraction function, the drum 14 will rotate at a high rate of speed relative to the blower housing 38 and the tub 12. During this rinse and spin function, the blower fan 34 will typically be idle such that the air pressure 62 around the labyrinth seal 50 will not be increased and the high-pressure area 60 is not formed. Accordingly, the labyrinth seal 50 includes a typical seal integrity that allows for less friction at the labyrinth seal 50. In turn, the drum 14 and the back wall 36 of the drum 14 are able to rotationally operate at a high rate of speed relative to the blower housing 38 and the tub 12 without generating unnecessary amounts of heat from friction or other surface-to-surface contact.

As described herein, the tub 12 includes a drain 116 having an outlet 114 that is defined within an outer wall 118 of the tub 12. This outlet 114 is positioned within the airflow path 20. Accordingly, wash fluid that may accumulate within the processing space 26, the blower housing 38, or other portion of the airflow path 20 can be conveniently directed to the lower section 90 of the tub 12 to be directed into the drain 116 for recycling or removal from the appliance 18.

Referring again to FIGS. 1-13, the labyrinth seal 50 defined herein can include various structures that engage with one another to form the labyrinth seal 50. These structures that form the labyrinth seal 50 are annular in nature, such that they extend around and concentric with the rotational axis 30 of the blower fan 34 and the drum 14. In this manner, the labyrinth seal 50 extends continuously around this rotational axis 30 and forms the sealing engagement within the labyrinth seal 50, as described herein.

Referring again to FIGS. 1-13, the combination washing and drying appliance 18 includes the tub 12 that is disposed within the outer cabinet 28. The drum 14 includes the back wall 36. The drum 14 and the back wall 36 are attached to one another and are rotationally operable within the tub 12 about the rotational axis 30. The airflow path 20 for the combination washing and drying appliance 18 is entirely contained within the tub 12 and is positioned within the interstitial space 24 defined between the drum 14 and the tub 12. The drain 116 is disposed within the lower section 90 of the tub 12 and the outlet 114 for the drain 116 is disposed within the airflow path 20 and is defined by an outer wall 118 of the tub 12. The blower fan 34 delivers process air 22 through the airflow path 20 that is contained within the tub 12. The blower fan 34 is disposed between the back wall 36 of the drum 14 and the blower housing 38 of the tub 12. The back wall 36 rotates with the drum 14 and is slidably engaged with the blower housing 38 to define a labyrinth seal 50. The blower fan 34 rotationally operates within the blower enclosure 32 defined between the back wall 36 of the drum 14 and the blower housing 38 of the tub 12. This blower enclosure 32 can also be referred to as a blower space or the cochlear space 170 that is defined by the blower housing 38. Moisture, typically in the form of condensate 110, is collected within the airflow path 20 is directed to the outlet 114 of the drain 116 for recycling within a fluid delivery system of the appliance 18 or for removal or other expulsion from the appliance 18.

Figure 11:
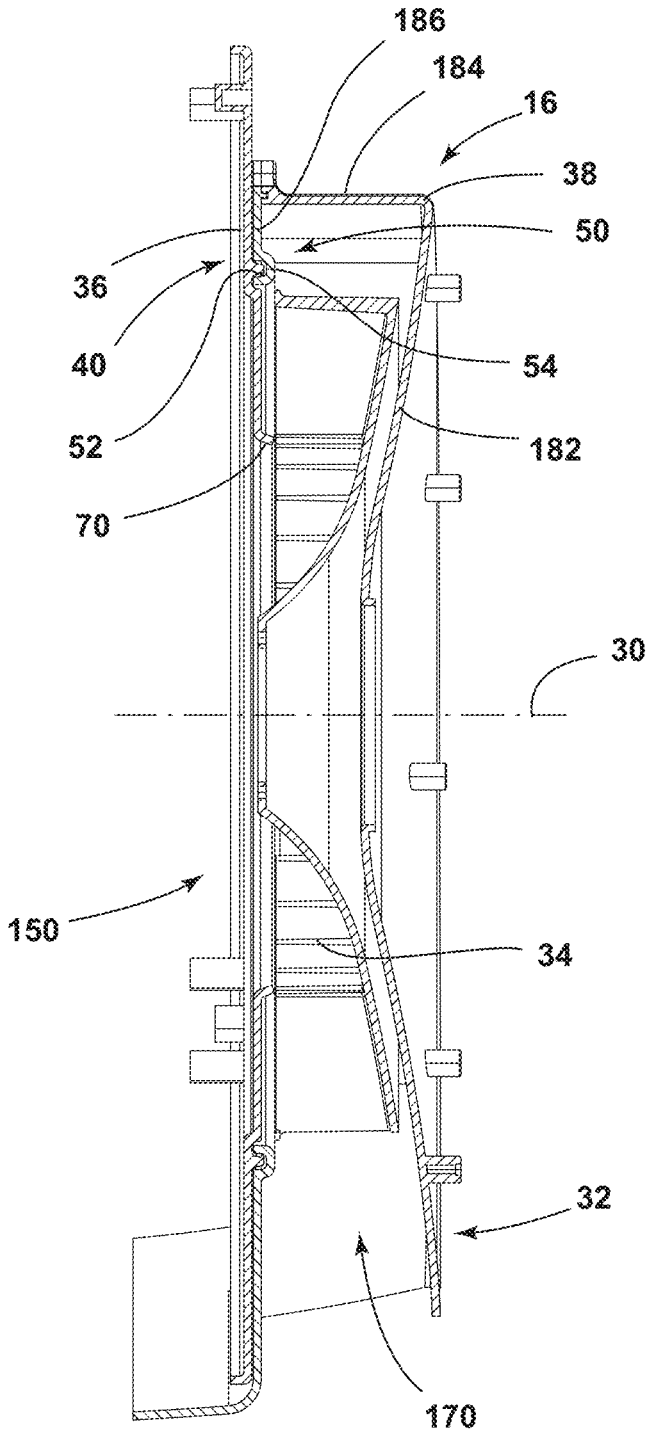
FIG. 11 is a cross-sectional view of the blower housing of FIG. 9 taken along the line XI-XI.
Figure 12:
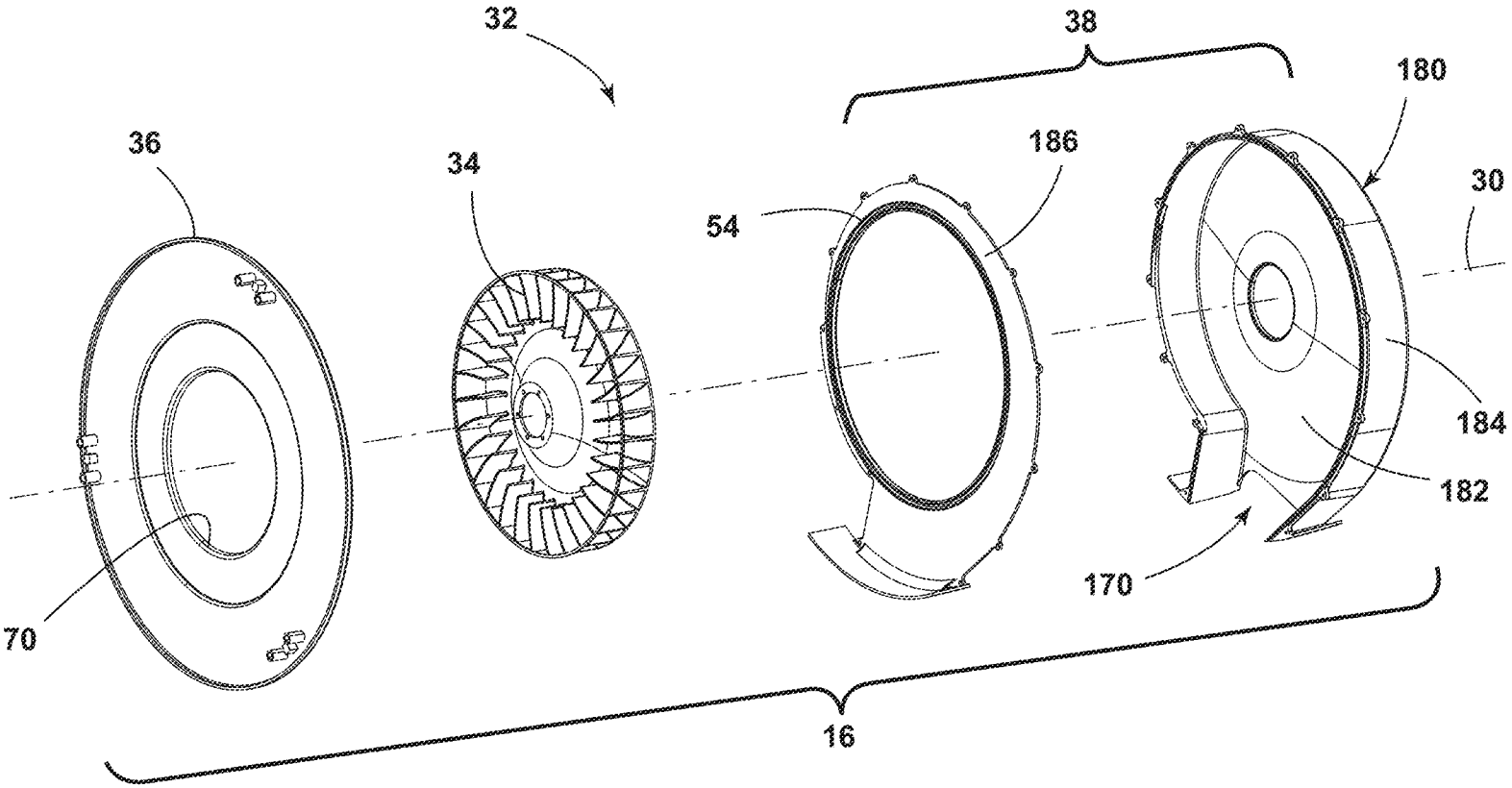
FIG. 12 is an exploded perspective view of the blower housing of FIG. 8.
Figure 13:
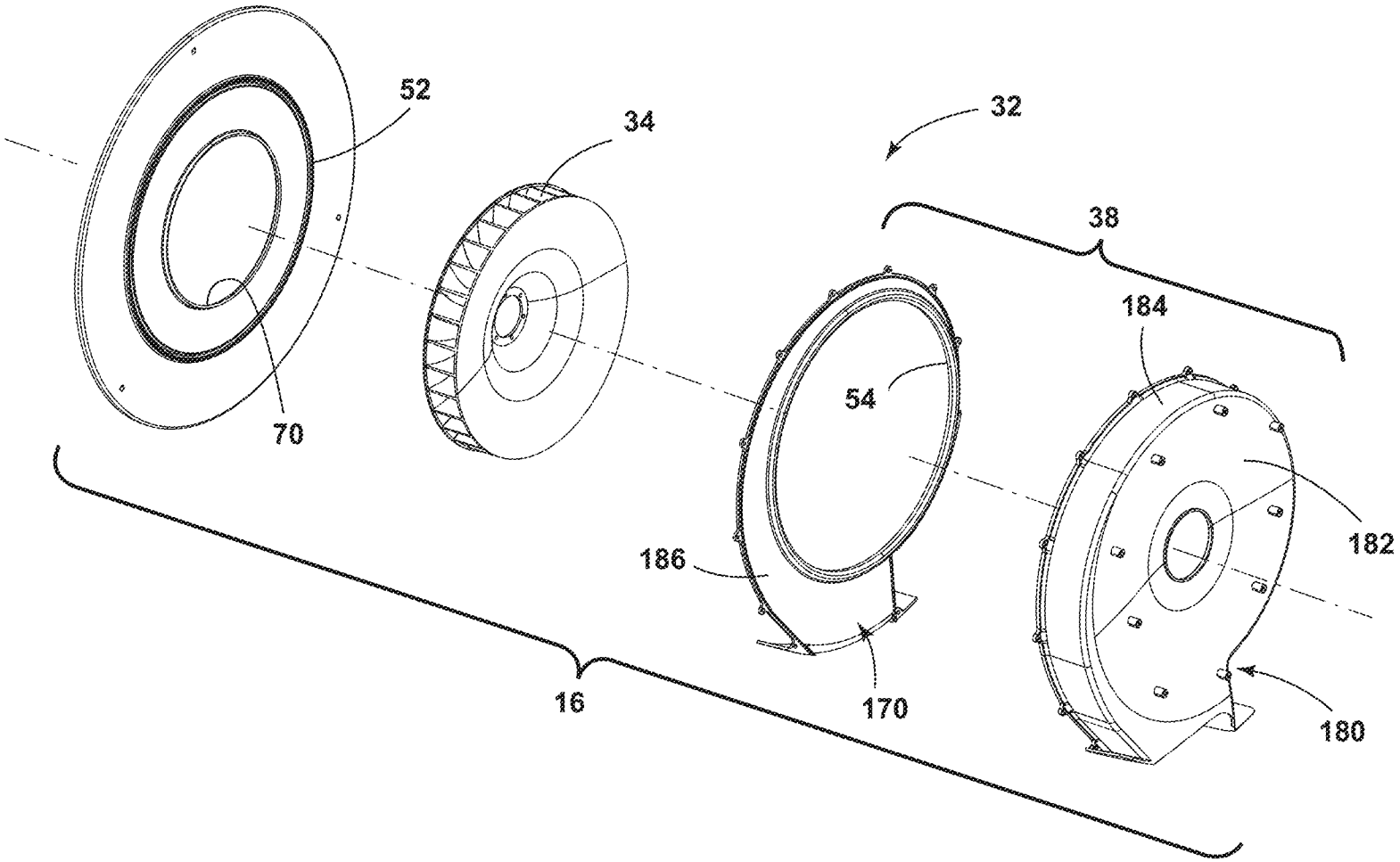
FIG. 13 is an exploded perspective view of the blower housing of FIG. 8.

Referring to FIGS. 11-13, the blower housing 38 can contain the blower fan 34 within the cochlear space 170. In such an aspect of the device, the blower housing 38 can include an enclosure panel 180 having a rear wall 182 and a sidewall 184. The sidewall 184 of the enclosure panel 180 is configured to attach to an interface panel 186. The interface panel 186 can include the annular channel 54 that forms a portion of the labyrinth seal 50. In this manner, the enclosure panel 180 and the interface panel 186 form the cochlear space 170 within which the blower fan 34 operates. The back wall 36 of the drum 14, as described herein, slidably engages the interface panel 186 of the blower housing 38.

According to various aspects of the device, use of the labyrinth seal 50 defined between the back wall 36 of the drum 14 and the blower housing 38 of the tub 12 forms a sealing engagement that provides for use of the airflow path 20 that is entirely contained within the tub 12. During certain aspects of the laundry cycle, such as a rinse cycle, spin cycle and other washing-type laundry functions (shown in FIG. 7), the labyrinth seal 50 may allow for movement and fluid and air between the blower enclosure 32 and the processing space 26 via the sliding engagement. During drying-functions of a laundry cycle or sections of a laundry cycle where the blower fan 34 is in operation (shown in FIG. 6), the increased air pressure 62 within the blower housing 38 creates a greater seal integrity at the labyrinth seal 50 and seals the airflow path 20 in the area of the blower enclosure 32. This sealed and sliding engagement prevents movement of process air 22 through the labyrinth seal 50 and to areas outside of the airflow path 20. Accordingly, process air 22 moving from the processing space 26 and to the blower enclosure 32 is directed through, and not around, the aperture 70 defined within the back wall 36 of the drum 14 and through the filtering mechanisms contained within the back wall 36. Moreover, ambient air 42 can be prevented from infiltrating into the airflow space through this labyrinth seal 50. This sealing engagement is generated while also allowing rotational operation of the drum 14 relative to the tub 12.

Because the labyrinth seal 50 is a dynamic seal that changes depending upon whether the blower fan 34 is being operated or not, certain functions of the drying appliance 18 are more readily operated depending upon the status of the blower fan 34. As described herein, during a rinse and spin function, and other washing-type functions, the blower fan 34 is idle and does not rotate. This normalizes the seal integrity at the labyrinth seal 50 and allows for a more convenient high-speed rotation of the drum 14 relative to the tub 12. When the blower fan 34 operates, such as during a drying function, the increased air pressure 62 generated by operation of the blower fan 34 creates the high-pressure area 60 that increases the seal integrity of the labyrinth seal 50 and prevents movement of process air 22 or ambient air 42 through this labyrinth seal 50. As described herein, because the drum 14 rotates at a slower rate of speed during the drying function, the heightened integrity of the labyrinth seal 50 provides for the slow rotation, or (tumble) of the drum 14 during performance of a drying function.

By using this configuration of the back wall 36 of the drum 14 and the blower housing 38, as well as the labyrinth seal 50 formed therebetween, a single space can be used for the airflow path 20 as well as a space for collecting condensate 110 and wash fluid used during operation of the appliance 18. Accordingly, greater efficiencies in the use of space are achieved that can provide for larger sizes of tubs 12 and rotating drums 14, as well as more components being disposed within a similar-sized outer cabinet 28.

The invention disclosed herein is further summarized in the following paragraphs and is further characterized by combinations of any and all of the various aspects described therein.

According to one aspect of the present disclosure, a combination washing and drying appliance includes a tub that is disposed within a cabinet. A drum is rotationally operable within the tub about a rotational axis. An airflow path is defined within an interstitial space between the drum and the tub. A blower fan operates to direct process air through the airflow path. The blower fan is disposed within a blower enclosure that is defined by a back wall of the drum and a blower housing that is attached to the tub. Engagement of the back wall of the drum and the blower housing of the tub defines a slidable engagement that is selectively sealed during operation of the blower fan to prevent the process air from leaving the airflow path and to further prevent aspiration of ambient air to the airflow path.

According to another aspect, the back wall rotates with the drum and the blower housing is rotationally fixed with respect to the tub.

According to another aspect, the slidable engagement is a labyrinth seal that is formed at an interface between the back wall of the drum and the blower housing.

According to another aspect, the blower fan and the drum rotationally operate about the rotational axis.

According to another aspect, a first motor rotationally operates the blower fan and a second motor rotationally operates the drum.

According to another aspect, the first motor is coupled to the blower fan via an inner drive shaft.

According to another aspect, the second motor is coupled with the drum via a hollow drive tube that surrounds a portion of the inner drive shaft.

According to another aspect, operation of the blower fan defines a high-pressure area that is disposed near the slidable engagement between the back wall and the blower housing.

According to another aspect, the high-pressure area defines the slidable engagement and a sealed engagement of the labyrinth seal that prevents aspiration of the ambient air into the airflow path.

According to another aspect, the slidable and sealed engagements of the labyrinth seal also prevents expiration of the process air away from the airflow path.

According to another aspect, the airflow path is entirely contained within the tub.

According to another aspect, the blower housing includes a cochlear space that directs the process air from the drum and through a portion of the airflow path that extends below the drum.

According to another aspect of the present disclosure, a combination washing and drying appliance includes a tub that is disposed within a cabinet. A drum has a back wall and is rotationally operable within the tub about a rotational axis. An airflow path is defined within an interstitial space between the drum and the tub. A drain is disposed within a lower section of the tub. An outlet for the drain is disposed within the airflow path. A blower fan delivers process air through the airflow path that is contained within the tub. The blower fan is disposed between the back wall of the drum and a blower housing of the tub. The back wall rotates with the drum and is slidably engaged with the blower housing to define a labyrinth seal. The blower fan rotationally operates within a blower enclosure that is defined between the back wall and the blower housing. Moisture collected in the airflow path is directed to the outlet of the drain.

According to another aspect, the labyrinth seal is disposed proximate a high-pressure area of the blower enclosure, and the high-pressure area is generated during operation of the blower fan.

According to another aspect, operation of the blower fan, the blower housing and the back wall are biased against one another within the labyrinth seal as a result of an increased air pressure within the high-pressure area.

According to another aspect, the increased air pressure increases a seal integrity of the labyrinth seal to prevent aspiration of ambient air into the airflow path.

According to another aspect, the increased air pressure further increases the seal integrity of the labyrinth seal to prevent expiration of the process air from the airflow path.

According to yet another aspect of the present disclosure, an air handling system for a laundry appliance includes a tub that is disposed within a cabinet. A drum has a back wall and is rotationally operable within the tub about a rotational axis. An airflow path is defined within an interstitial space between the drum and the tub. A blower fan delivers process air through the airflow path that is contained within the tub. The blower fan is disposed between the back wall of the drum and a blower housing of the tub. The back wall rotates with the drum and is slidably engaged with the blower housing to define a labyrinth seal. The blower fan rotationally operates within a blower enclosure that is defined between the back wall and the blower housing.

According to another aspect, the labyrinth seal is disposed proximate a high-pressure area of the blower enclosure. The high-pressure area is generated during operation of the blower fan, and, during operation of the blower fan, the blower housing and the back wall are biased against one another within the labyrinth seal as a result of an increased air pressure within the high-pressure area.

According to another aspect, the increased air pressure increases a seal integrity of the labyrinth seal to prevent aspiration of ambient air into the airflow path. The increased air pressure further increases the seal integrity of the labyrinth seal to prevent expiration of the process air from the airflow path.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A combination washing and drying appliance comprising:

a tub disposed within a cabinet;

a drum that is rotationally operable within the tub about a rotational axis, wherein an airflow path is defined within an interstitial space between the drum and the tub; and a blower fan that operates to direct process air through the airflow path, the blower fan disposed within a blower enclosure defined by a back wall of the drum and a blower housing that is attached to the tub, wherein engagement of the back wall of the drum and the blower housing of the tub defines a slidable engagement that is selectively sealed during operation of the blower fan to prevent the process air from leaving the airflow path and to further prevent aspiration of ambient air to the airflow path.

2. The combination washing and drying appliance of claim 1, wherein the back wall rotates with the drum and the blower housing is rotationally fixed with respect to the tub.

3. The combination washing and drying appliance of claim 1, wherein the slidable engagement is a labyrinth seal that is formed at an interface between the back wall of the drum and the blower housing.

4. The combination washing and drying appliance of claim 1, wherein the blower fan and the drum rotationally operate about the rotational axis.

5. The combination washing and drying appliance of claim 1, wherein a first motor rotationally operates the blower fan and a second motor rotationally operates the drum.

6. The combination washing and drying appliance of claim 5, wherein the first motor is coupled to the blower fan via an inner drive shaft.

7. The combination washing and drying appliance of claim 6, wherein the second motor is coupled with the drum via a hollow drive tube that surrounds a portion of the inner drive shaft.

8. The combination washing and drying appliance of claim 3, wherein operation of the blower fan defines a high-pressure area that is disposed near the slidable engagement between the back wall and the blower housing.

9. The combination washing and drying appliance of claim 8, wherein the high-pressure area defines the slidable engagement and a sealed engagement of the labyrinth seal that prevents aspiration of the ambient air into the airflow path.

10. The combination washing and drying appliance of claim 9, wherein the slidable and sealed engagements of the labyrinth seal also prevents expiration of the process air away from the airflow path.

11. The combination washing and drying appliance of claim 1, wherein the airflow path is entirely contained within the tub.

12. The combination washing and drying appliance of claim 1, wherein the blower housing includes a cochlear space that directs the process air from the drum and through a portion of the airflow path that extends below the drum.

13. A combination washing and drying appliance comprising:

a tub disposed within a cabinet;

a drum having a back wall, wherein the drum is rotationally operable within the tub about a rotational axis, wherein an airflow path is defined within an interstitial space between the drum and the tub;

a drain disposed within a lower section of the tub, an outlet for the drain disposed within the airflow path; and a blower fan that delivers process air through the airflow path that is contained within the tub, the blower fan disposed between the back wall of the drum and a blower housing of the tub, wherein the back wall rotates with the drum and is slidably engaged with the blower housing to define a labyrinth seal, and wherein the blower fan rotationally operates within a blower enclosure defined between the back wall and the blower housing, and wherein moisture collected in the airflow path is directed to the outlet of the drain.

14. The combination washing and drying appliance of claim 13, wherein the labyrinth seal is disposed proximate a high-pressure area of the blower enclosure, wherein the high-pressure area is generated during operation of the blower fan.

15. The combination washing and drying appliance of claim 14, wherein during operation of the blower fan, the blower housing and the back wall are biased against one another within the labyrinth seal as a result of an increased air pressure within the high-pressure area.

16. The combination washing and drying appliance of claim 15, wherein the increased air pressure increases a seal integrity of the labyrinth seal to prevent aspiration of ambient air into the airflow path.

17. The combination washing and drying appliance of claim 16, wherein the increased air pressure further increases the seal integrity of the labyrinth seal to prevent expiration of the process air from the airflow path.

18. An air handling system for a laundry appliance, the air handling system comprising:

a tub disposed within a cabinet;

a drum having a back wall, wherein the drum is rotationally operable within the tub about a rotational axis, wherein an airflow path is defined within an interstitial space between the drum and the tub; and a blower fan that delivers process air through the airflow path that is contained within the tub, the blower fan disposed between the back wall of the drum and a blower housing of the tub, wherein the back wall rotates with the drum and is slidably engaged with the blower housing to define a labyrinth seal, and wherein the blower fan rotationally operates within a blower enclosure defined between the back wall and the blower housing.

19. The air handling system of claim 18, wherein the labyrinth seal is disposed proximate a high-pressure area of the blower enclosure, wherein the high-pressure area is generated during operation of the blower fan, and wherein during operation of the blower fan, the blower housing and the back wall are biased against one another within the labyrinth seal as a result of an increased air pressure within the high-pressure area.

20. The air handling system of claim 19, wherein the increased air pressure increases a seal integrity of the labyrinth seal to prevent aspiration of ambient air into the airflow path, and wherein the increased air pressure further increases the seal integrity of the labyrinth seal to prevent expiration of the process air from the airflow path.

* * * * *